US012304684B2

(12) United States Patent
O'Connell et al.

(10) Patent No.: US 12,304,684 B2
(45) Date of Patent: May 20, 2025

(54) LINER CRIMP DEVICE

(71) Applicant: CONTAINMENT SERVICE PROVIDERS COMPANY LIMITED, County Cork (IE)

(72) Inventors: Kevin O'Connell, County Cork (IE); Anthony O'Connell, County Cork (IE)

(73) Assignee: Containment Service Providers Company Limited, County Cork (IE)

( * ) Notice: Subject to any disclaimer, the term of this patent is extended or adjusted under 35 U.S.C. 154(b) by 141 days.

(21) Appl. No.: 18/177,436

(22) Filed: Mar. 2, 2023

(65) Prior Publication Data

US 2023/0278734 A1 Sep. 7, 2023

(30) Foreign Application Priority Data

Mar. 4, 2022 (EP) ..... 22160220

(51) Int. Cl.
*B65B 7/06* (2006.01)
*B65B 51/04* (2006.01)
*B65B 61/06* (2006.01)

(52) U.S. Cl.
CPC ..... *B65B 7/06* (2013.01); *B65B 51/046* (2013.01); *B65B 61/06* (2013.01); *B65B 51/04* (2013.01)

(58) Field of Classification Search
CPC ..... B65B 7/06; B65B 61/06
(Continued)

(56) References Cited

U.S. PATENT DOCUMENTS

RE36,544 E * 2/2000 Madsen ..... B65D 33/1616 292/307 R
7,770,936 B2 * 8/2010 Koch ..... B65D 33/16 141/10

(Continued)

FOREIGN PATENT DOCUMENTS

DE 201 17 669 U1 3/2002
EP 2112084 A1 10/2009

(Continued)

OTHER PUBLICATIONS

Frangible—definition by Merriam Webster Dictionary . Retrieved from URL https://www.merriam-webster.com/dictionary/frangible on Sep. 19, 2024 (Year: 2024).*

(Continued)

*Primary Examiner* — Stephen F. Gerrity
*Assistant Examiner* — Linda J Hodge
(74) *Attorney, Agent, or Firm* — Studebaker Brackett PLLC

(57) ABSTRACT

A bag film crimping device has a socket having top and bottom components joined by a bridge. Each socket component has a pair of opposed limbs, and each limb having inwardly directed teeth. A plug fits between the limbs with a friction fit in a movement from proximal to distal, and it has outwardly directed teeth for engagement with the teeth of the socket. A cover slide over the socket to cover a space at a distal end between the limbs when the socket and plug components have been separated after crimping. The cover includes has tines for prising a socket limb from the plug as the cover is pressed distally after it has previously been used to cover exposed edges of film after crimping and the top and bottom components have been separated.

14 Claims, 14 Drawing Sheets

(58) Field of Classification Search
USPC ..... 53/88; 24/30.5 R, 30.5 L
See application file for complete search history.

(56) References Cited

U.S. PATENT DOCUMENTS

| | | | | |
|---|---|---|---|---|
| 8,122,924 | B2 * | 2/2012 | Koch | B65D 33/2541 285/227 |
| 9,009,924 | B2 * | 4/2015 | Schnyder | B65D 33/1616 24/30.5 R |
| 2005/0084181 | A1 * | 4/2005 | Koch | B65D 33/30 211/94.01 |
| 2006/0053596 | A1 * | 3/2006 | Canegallo | F16K 24/048 24/30.5 R |
| 2007/0191167 | A1 * | 8/2007 | Koch | B65B 1/28 475/1 |
| 2007/0277478 | A1 * | 12/2007 | Koch | B65D 33/16 53/329 |
| 2009/0267303 | A1 * | 10/2009 | Nuppenau | B65D 63/1027 24/30.5 R |
| 2011/0247300 | A1 * | 10/2011 | Schleucher | B65D 33/1641 53/138.4 |
| 2012/0159741 | A1 * | 6/2012 | Schnyder | B65D 33/1616 24/30.5 L |
| 2014/0250636 | A1 * | 9/2014 | Vantrease | B65D 33/1625 24/30.5 S |
| 2023/0278734 | A1 * | 9/2023 | O'Connell | B65B 51/046 53/481 |

FOREIGN PATENT DOCUMENTS

| | | | |
|---|---|---|---|
| EP | 2 128 031 | A1 | 12/2009 |
| EP | 2468651 | A2 | 6/2012 |
| GB | 2464116 | A | 4/2010 |
| WO | 2005/012104 | A3 | 2/2005 |

OTHER PUBLICATIONS

Break—definition by Merriam Webster Dictionary . Retrieved from URL https://www.merriam-webster.com/dictionary/break on Sep. 19, 2024 (Year: 2024).*

When—definition by Merriam Webster Dictionary . Retrieved from URL https://www.merriam-webster.com/dictionary/when on Sep. 19, 2024 (Year: 2024).*

The extended European search report issued by the European Patent Office on Sep. 27, 2023, which corresponds to EP 23159394.8-1014 and is related to U.S. Appl. No. 18/177,436.

* cited by examiner

Section A-A

Section C-C

Section B-B

Figure 3A:
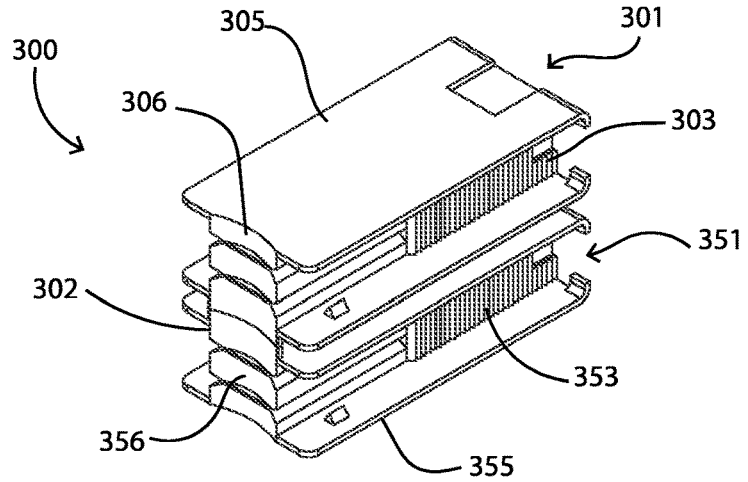
Figure 3B:
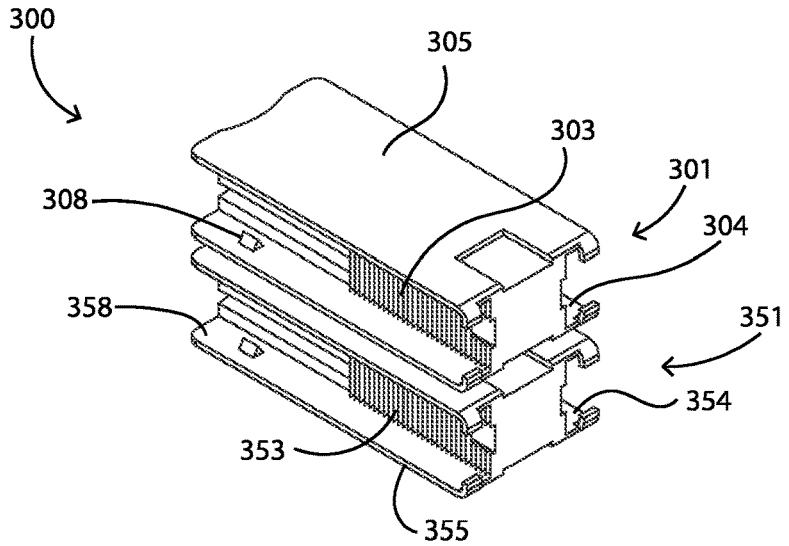
Figure 3C:
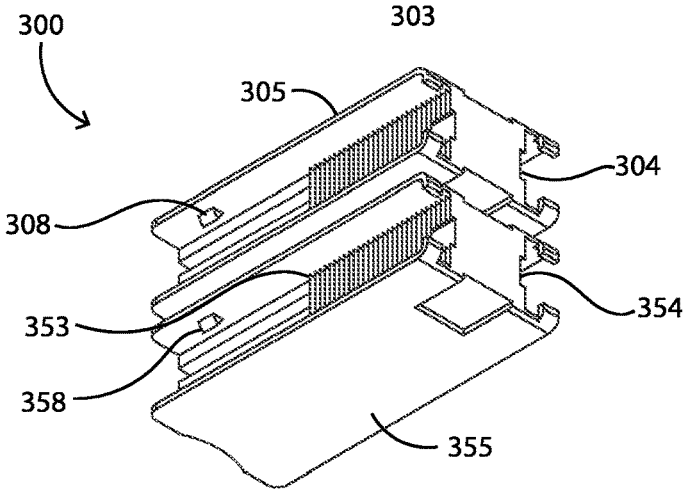

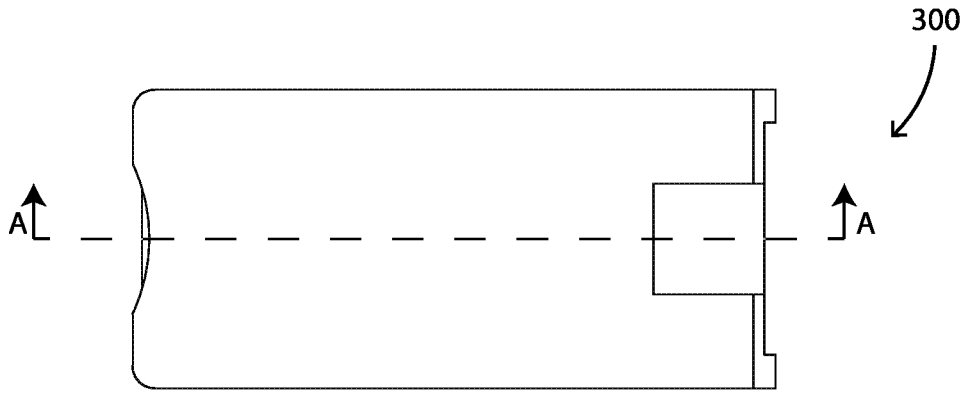
Fig.3(d)
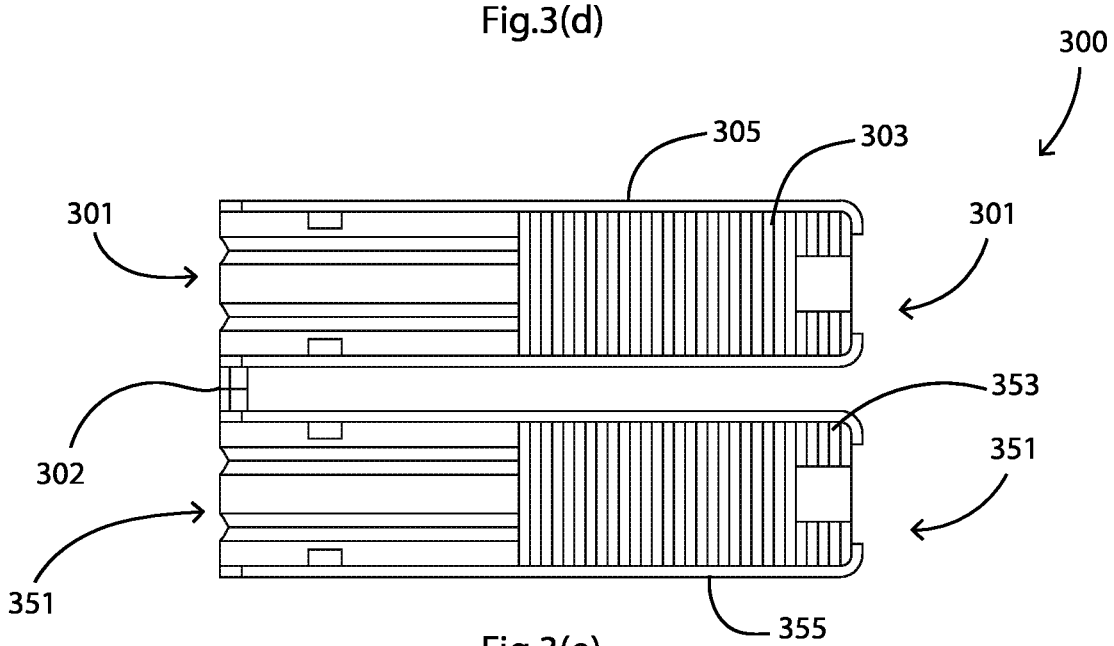
Fig.3(e)
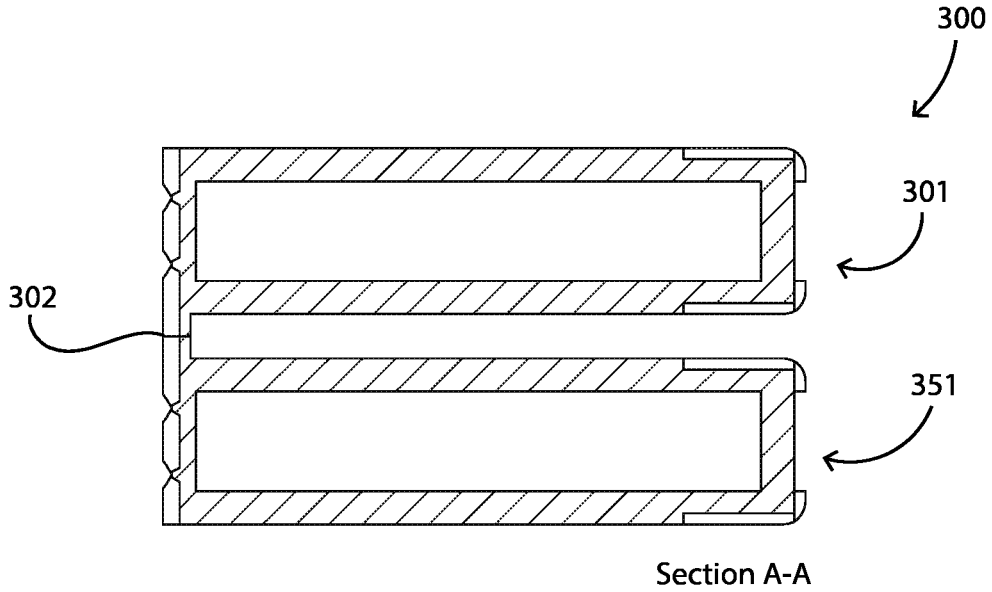
Fig.3(f )

LINER CRIMP DEVICE

INTRODUCTION

The present invention relates to crimping of liners such as the mouths of plastics liner film for containers of powders in any industry where required.

Such devices are described in EP2112084 (Fette GmbH), EP2468651 (V. Schnyder), GB2464116 (Heaton Green Containment Ltd.), and US2012/0159741 (Schnyder).

Objectives of the present invention are to provide a crimp device which is simpler to use, and/or provides improved sealing of the liner opening, and/or requires fewer components.

SUMMARY OF THE INVENTION

We describe a bag or liner film crimping device comprising:

- a socket having top and bottom components linked by a frangible bridge, each component having a pair of opposed limbs extending proximally;
- a plug having top and bottom components linked by a frangible bridge and being configured to fit between the socket limbs with a friction fit in a movement from proximal at an open end of the socket to distal when inserted in the socket; and
- a cover comprising a top wall and being configured to slide over the socket bottom component to a covering position at which the top wall covers a space at the distal end between the limbs when the socket and plug top and bottom components have been separated by breaking the bridges after crimping.

In some examples, the cover is dual-purpose and includes at least one tine for, in a second use after removal from said covering position, prising a socket limb from the plug as the cover is pressed distally.

In some examples, the cover comprises at least two tines, at least one for each interface between a socket limb and the plug. In some examples, the cover comprises the top wall, and an end wall, and the tines extend from the end wall.

In some examples, the socket includes recesses to accommodate the tines when the cover is in the covering position. In some examples, at least one limb of said socket top and bottom components has inwardly directed teeth.

In some examples, at least one plug component has outwardly directed teeth for engagement with the teeth of the socket.

In some examples, the cover and the plug lower component are configured to engage each other to be removed as a unit to expose the socket lower component limbs and allow removal of a liner through the socket in the proximal direction.

In some examples, the plug lower component and the cover comprises snap-fitting features configured for engaging together when the cover has been pressed distally to prise the socket limbs apart.

In some examples, said features comprise ridges on the plug or the cover and slots in the plug or the cover.

In some examples, the socket is symmetrical about a lateral plane in the proximal-distal direction and being through the socket bridge, and wherein the plug is symmetrical about a lateral plane in the proximal-distal direction and being through the plug bridge, whereby the first and second components are interchangeable.

In some examples, the device comprises at least two covers, one configured to act as a cover for the bottom socket component and one configured to act as a cover for the top component, after separation of said components.

We also describe a method of use of a device as described herein in any example, the method comprising:

- crimping a film within the socket by pressing the plug distally into the socket, cutting through the film and the bridges between the top and bottom socket and plug components, and
- pressing the cover proximally onto the lower socket and plug components to a covering position so that it covers exposed edges of the film.

In some examples, the cover is dual-purpose and includes at least one tine, and the method comprises further steps of removing the cover from the covering position and pressing the cover distally so that its tines prise open the socket limbs, and releasing the crimped film.

In some examples, the cover and the plug are removed together, and the liner is removed by proximal movement between and away from the socket limbs. Preferably, the cover is pressed distally until snap-fitting features of the cover and the plug engage.

We also describe a bag or liner film crimping device comprising:

- a socket having top and bottom components linked by a bridge, each component having a pair of opposed limbs;
- a plug having top and bottom components linked by a bridge and being configured to fit between the socket limbs with a friction fit in a movement from proximal to distal; and
- a cover configured to slide over the socket to cover a space at a distal end between the limbs when the socket and plug components have been separated after crimping.

Preferably, the cover is dual-purpose and includes at least one tine for, in a second use, prising a socket limb from the plug as the cover is pressed distally. Preferably, the cover comprises at least two tines, at least one for each interface between a socket limb and the plug. Preferably, the cover comprises the top wall and an end wall, and the tines extend from the end wall.

Preferably, the socket includes recesses to accommodate the tines when the cover is in the covering position. Preferably, at least one limb of said socket top and bottom components has inwardly directed teeth. Preferably, at least one plug component has outwardly directed teeth for engagement with the teeth of the socket.

We also describe a method of use of a device of any example, the method comprising:

- crimping a film within the socket by pressing the plug distally into the socket, cutting through the film and the bridges between the top and bottom socket and plug components, and
- pressing the cover proximally onto the lower socket and plug components so that it covers exposed edges of the film.

Preferably, the cover is dual-purpose and includes at least one tine, and the method comprises further steps of removing the cover and pressing the cover distally so that its tines prise open the socket limbs and releasing the crimped film.

DETAILED DESCRIPTION OF THE INVENTION

Figure 1:
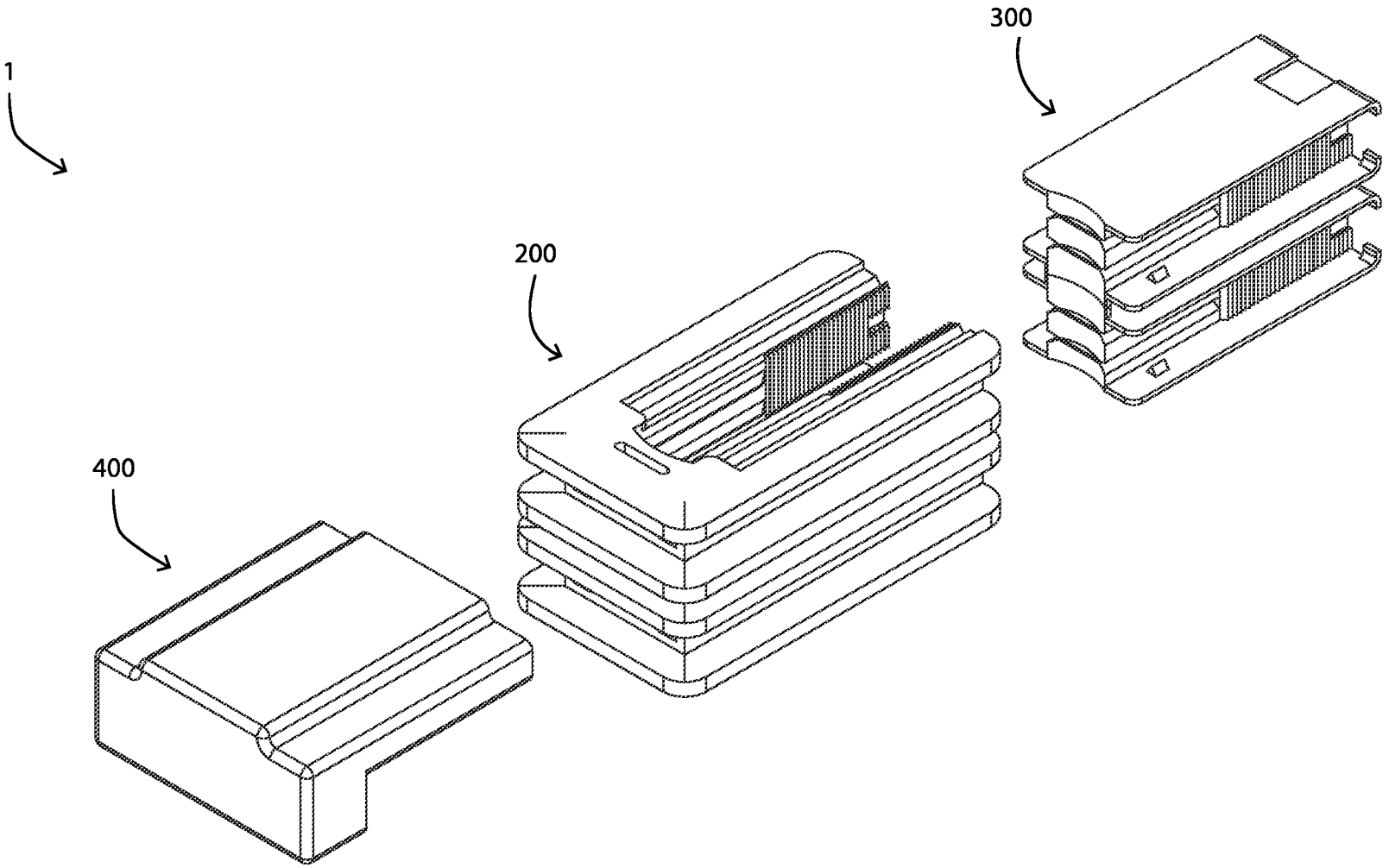
Figure 2A:
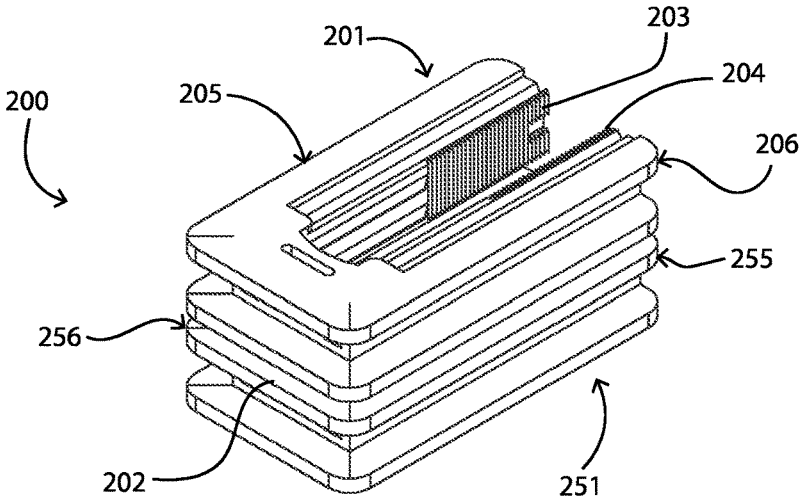
Figure 2B:
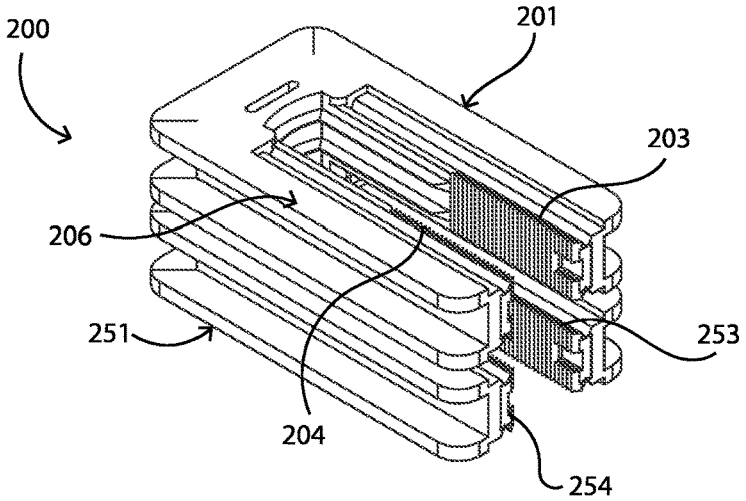
Figure 2C:
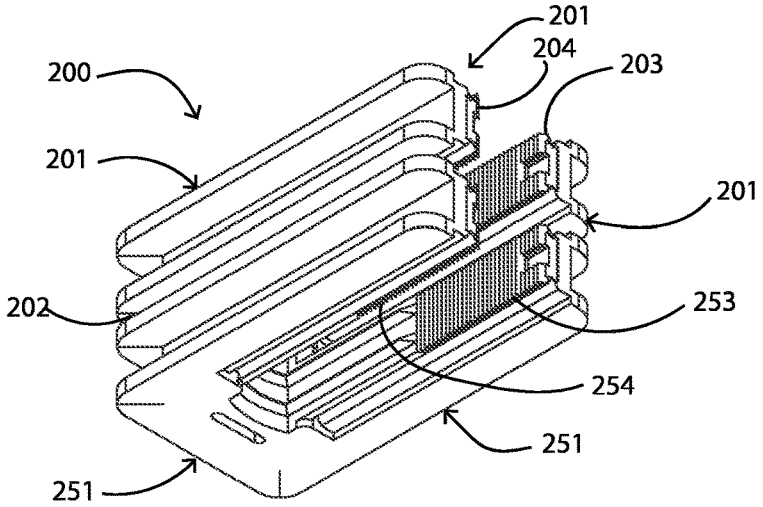
Figure 2E:
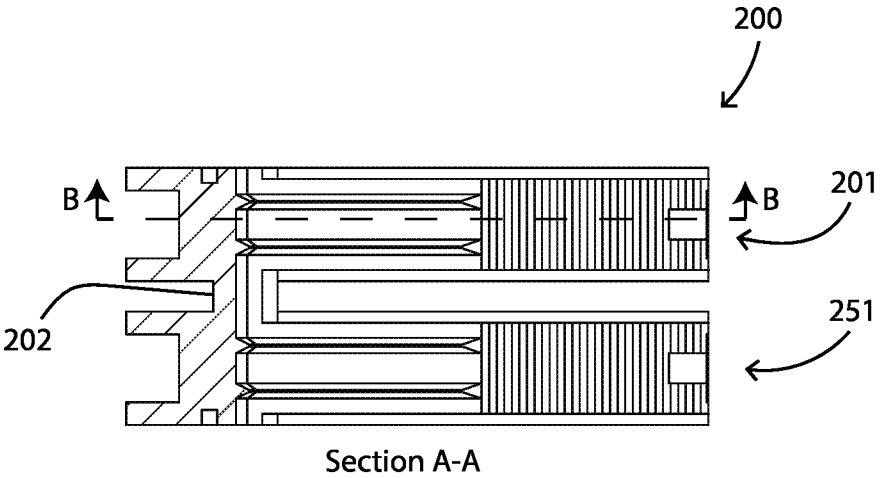
Figure 2G:
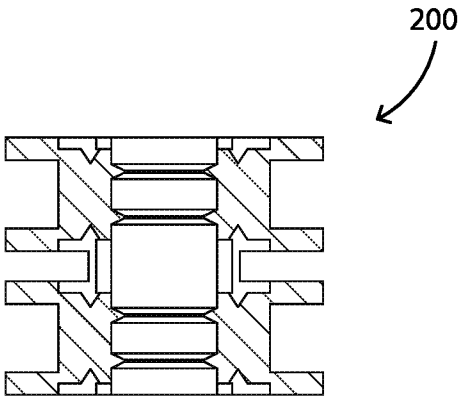
Figure 2D:
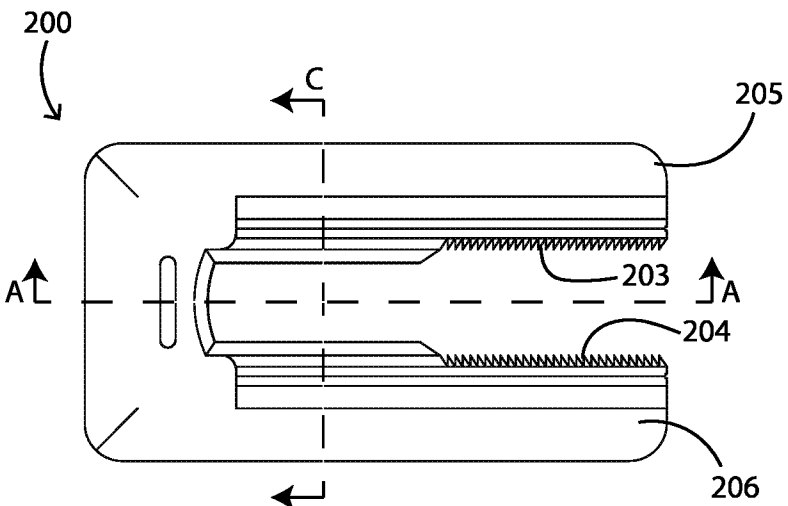
Figure 2F:
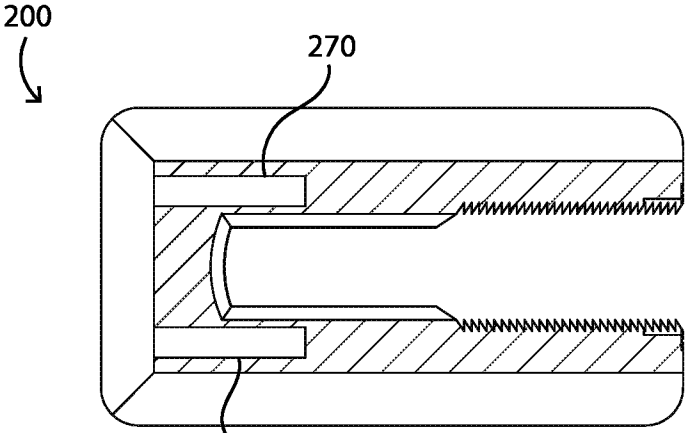
Figure 4A:
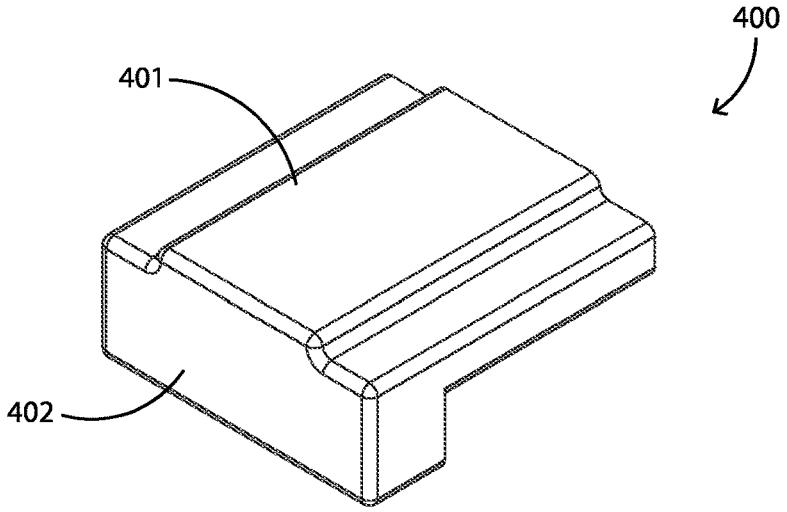
Figure 4B:
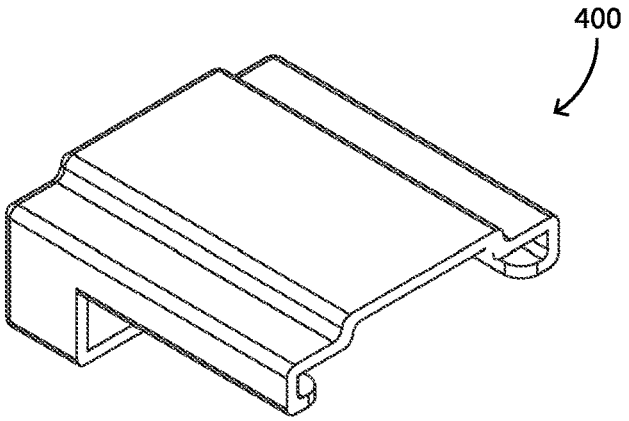
Figure 4C:
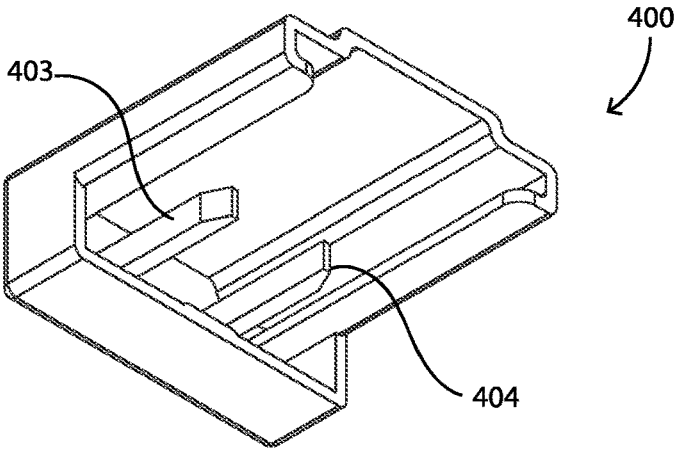
Figure 5A:
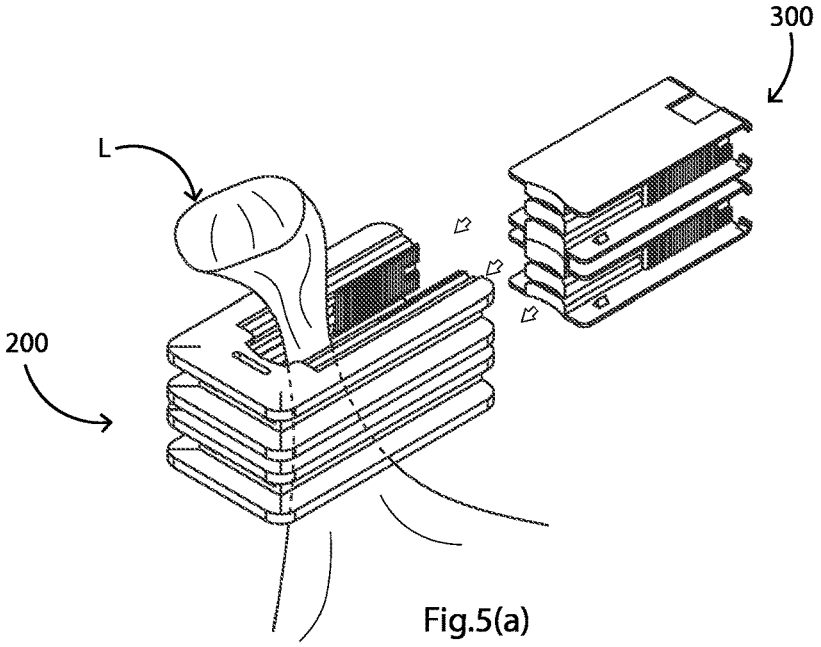
Figure 5B:
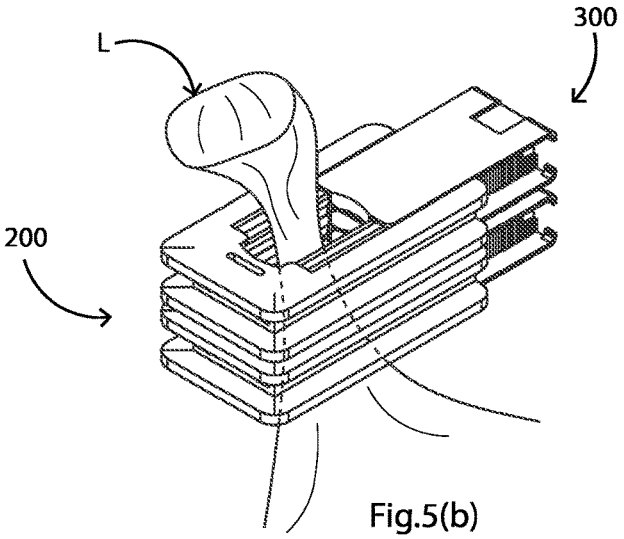
Figure 5C:
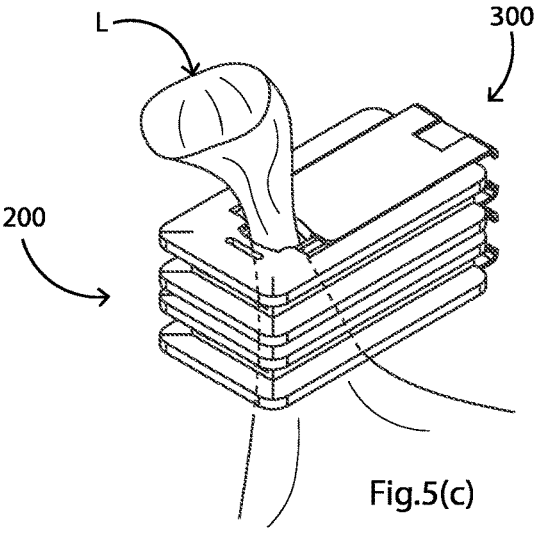
Figure 6:
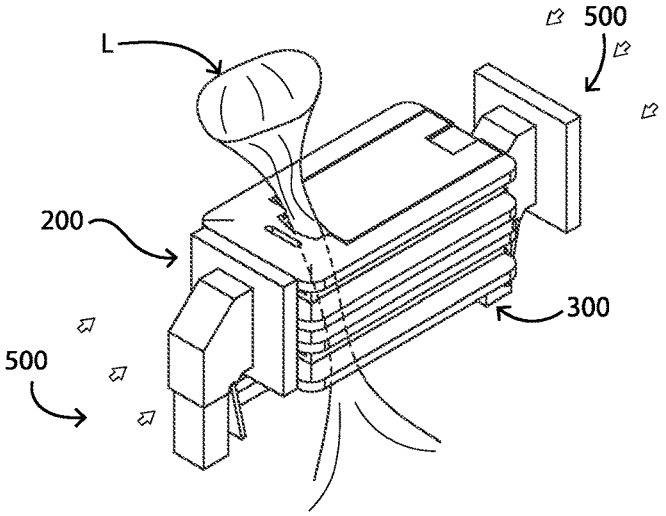
Figure 7:
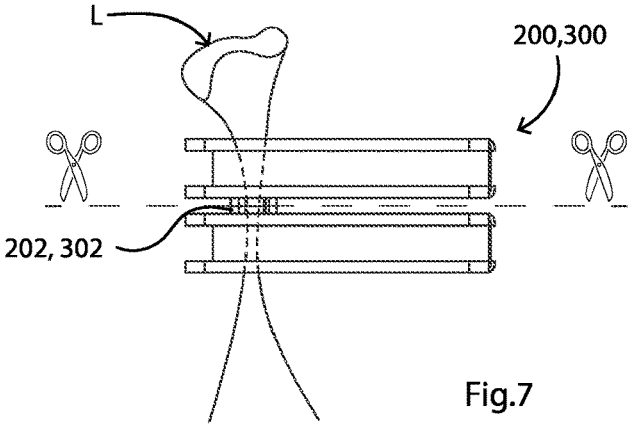
Figure 8:
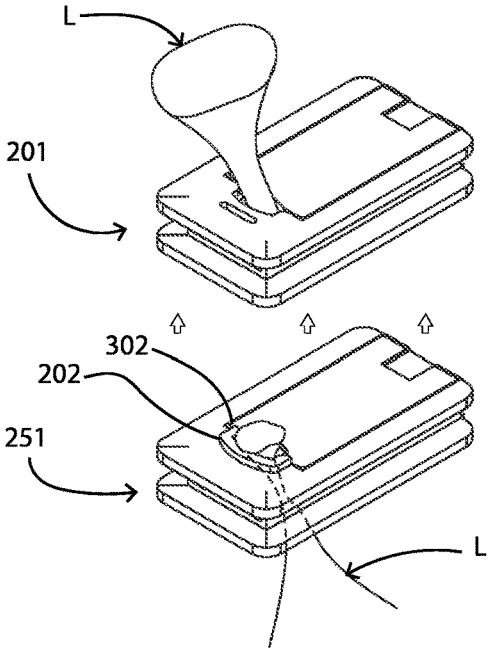
Figure 9:
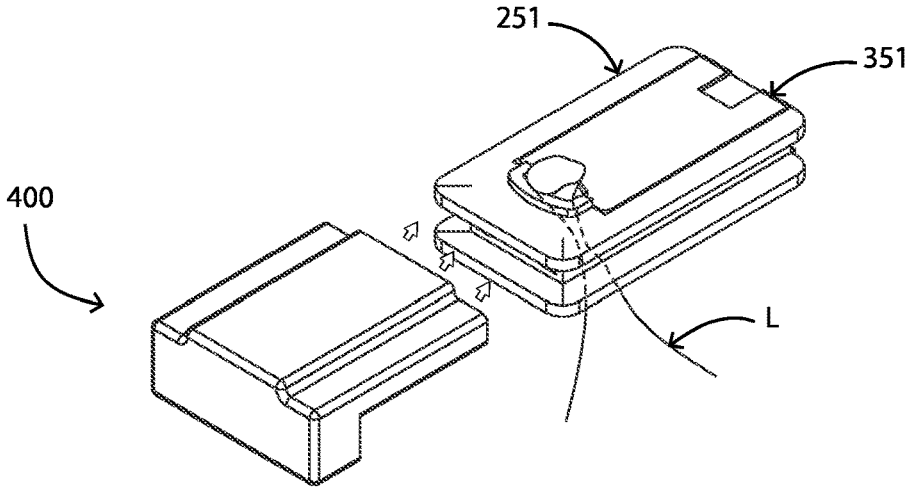
Figure 10:
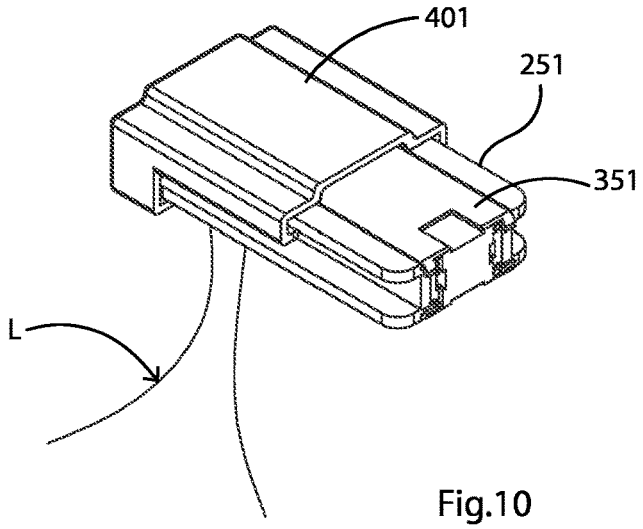
Figure 11:
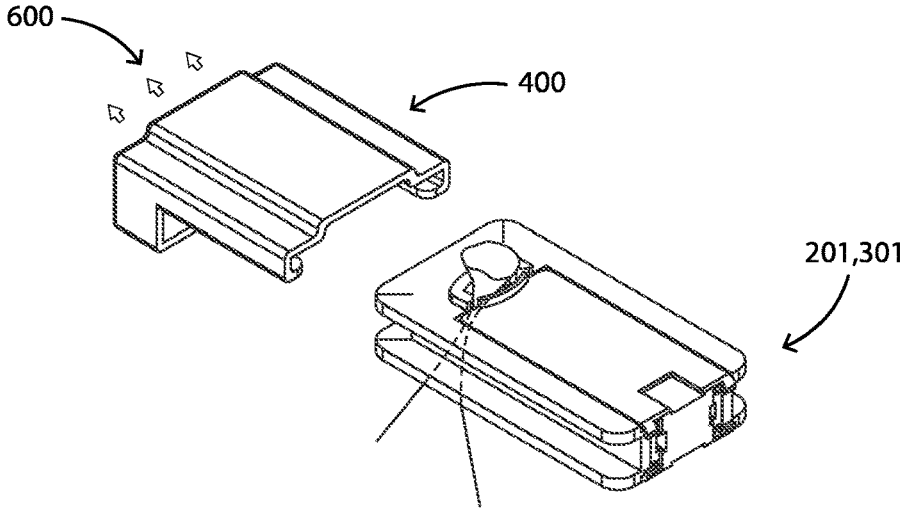
Figure 12:
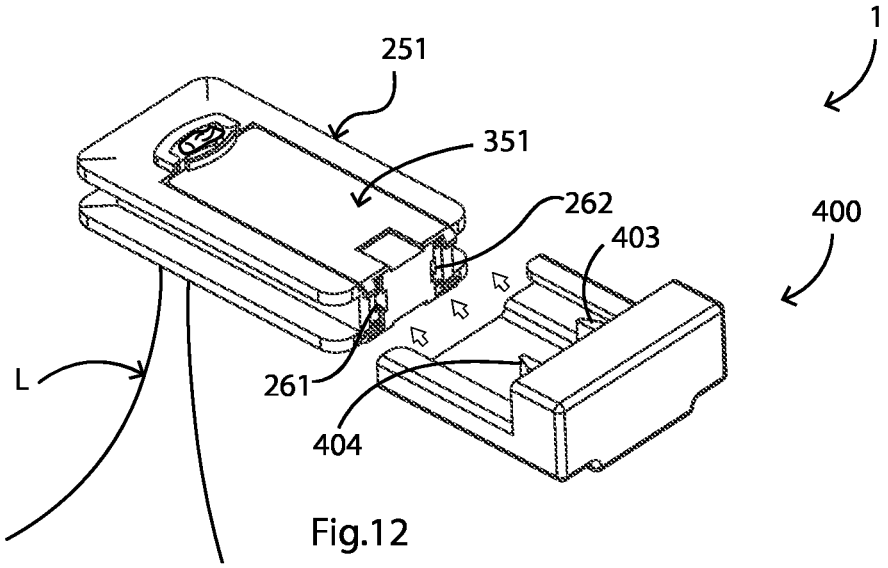
Figure 13:
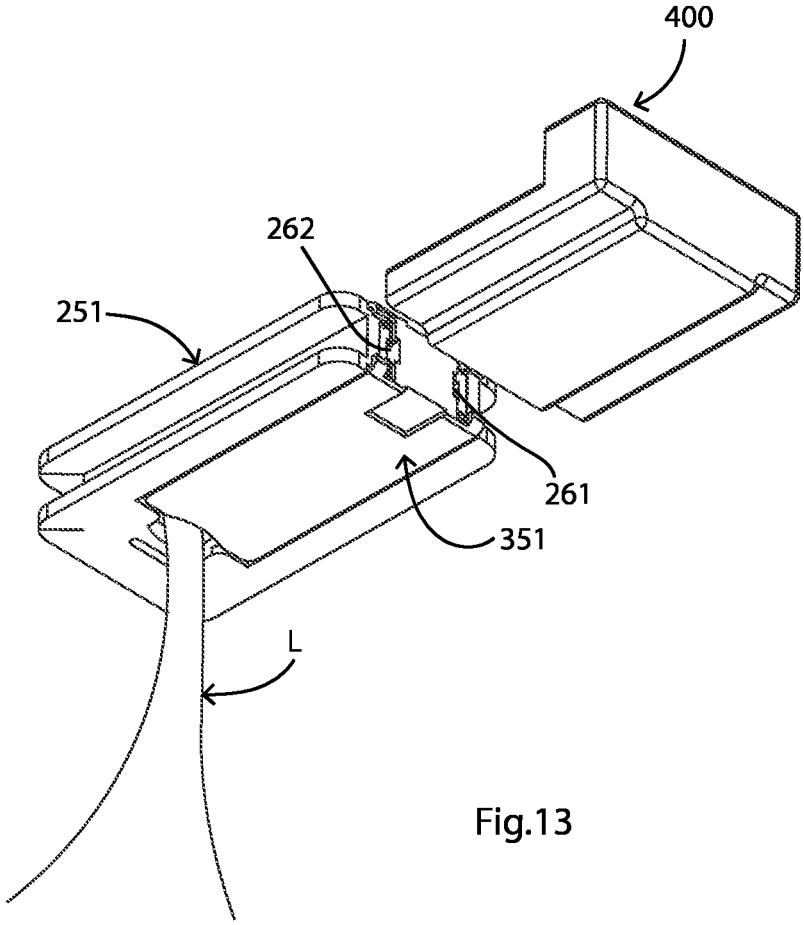
Figure 14:
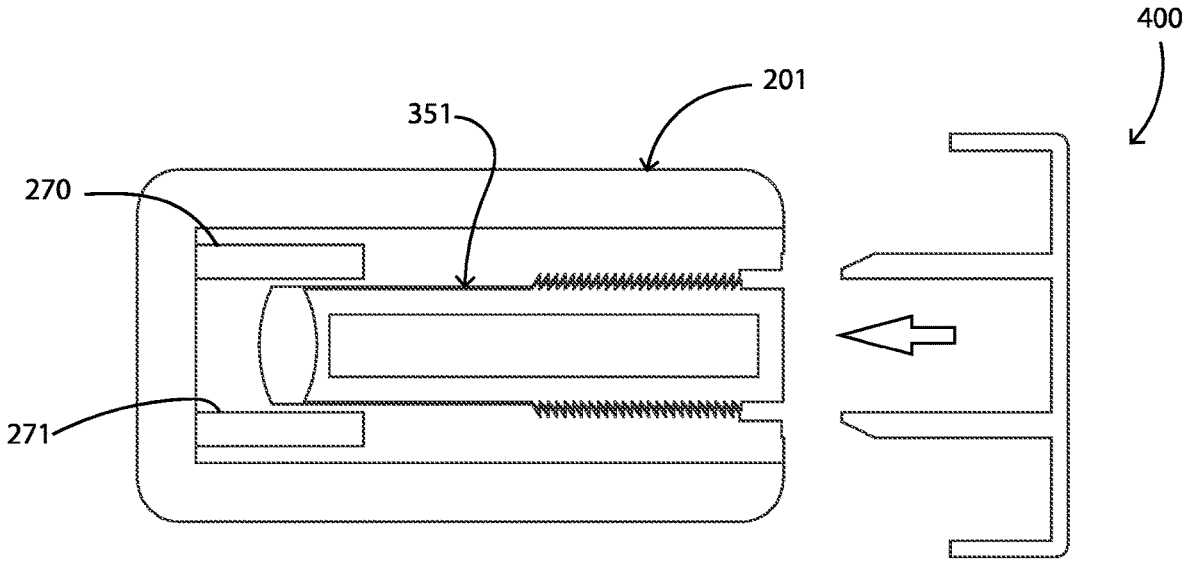
Figure 15:
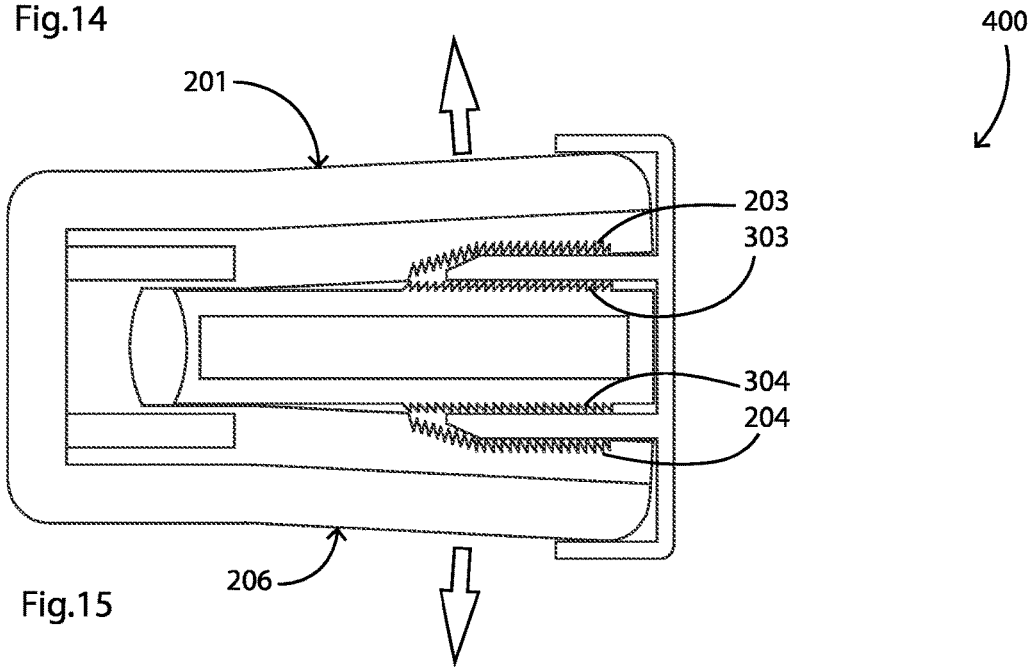
Figure 16:
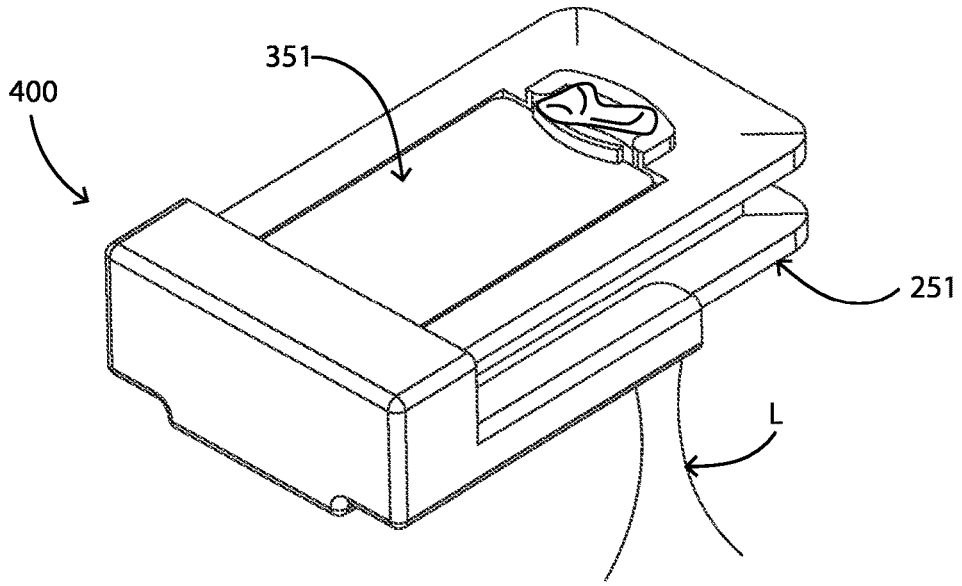
Figure 17:
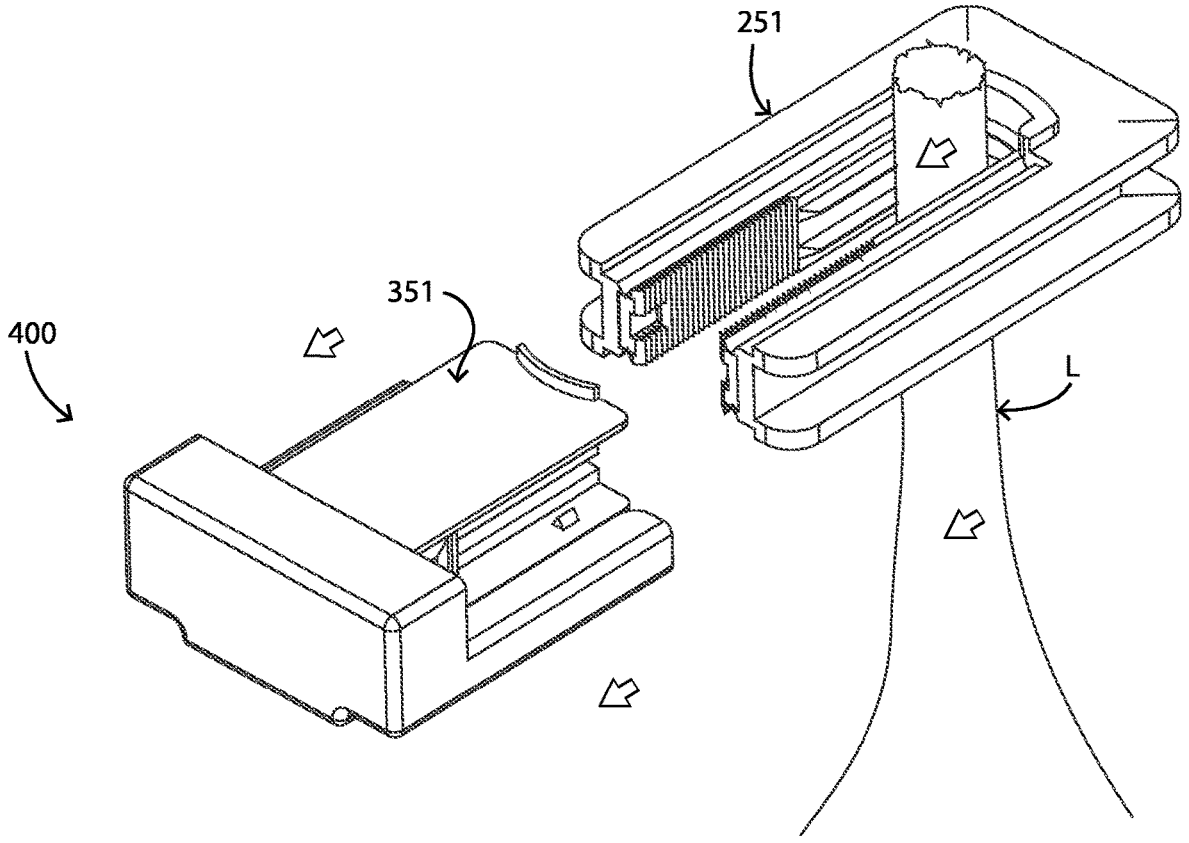
Figure 18:
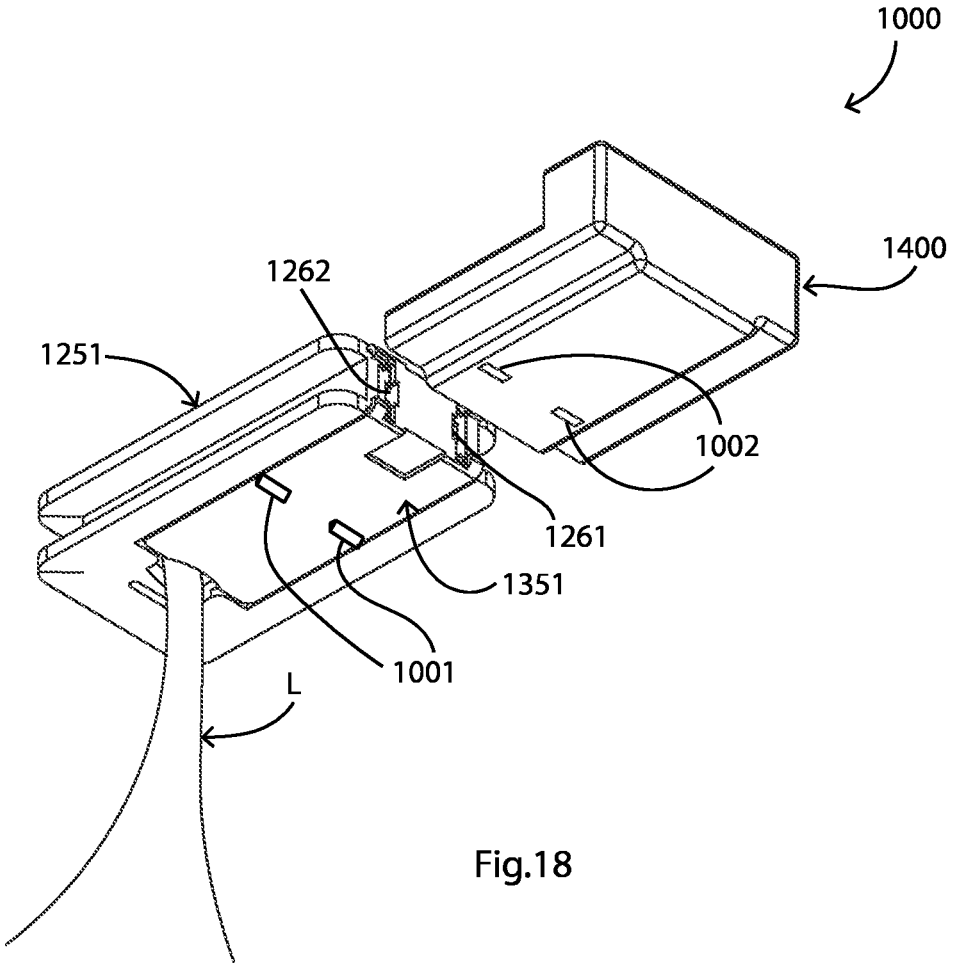
Figure 19A:
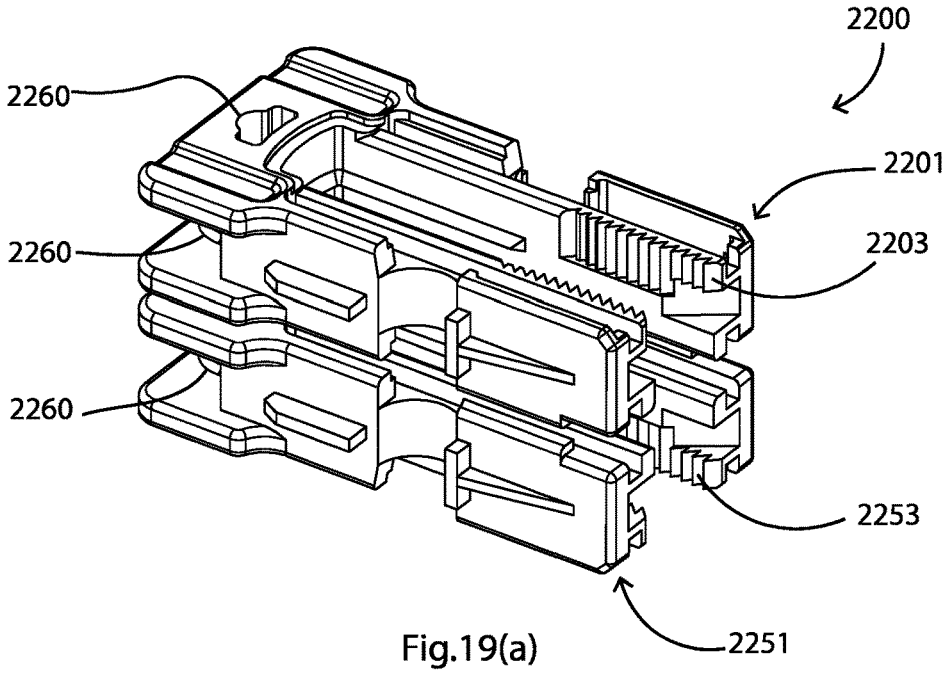
Figure 19B:
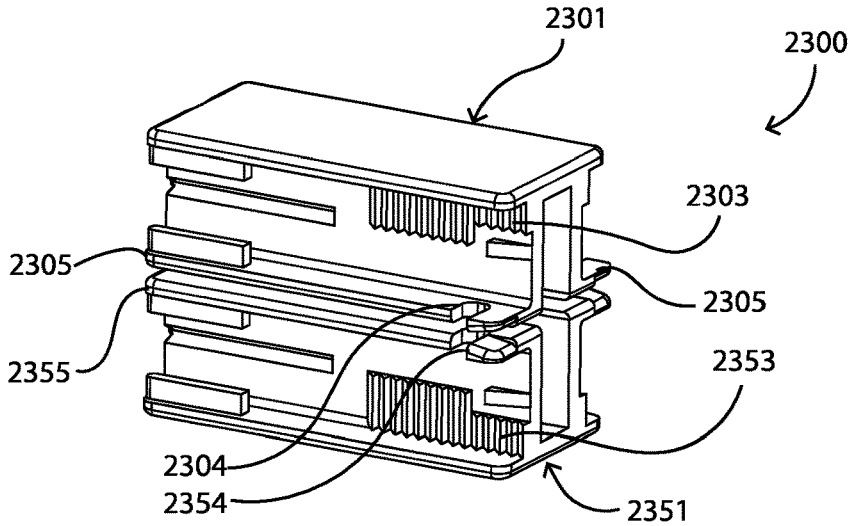
Figure 19C:
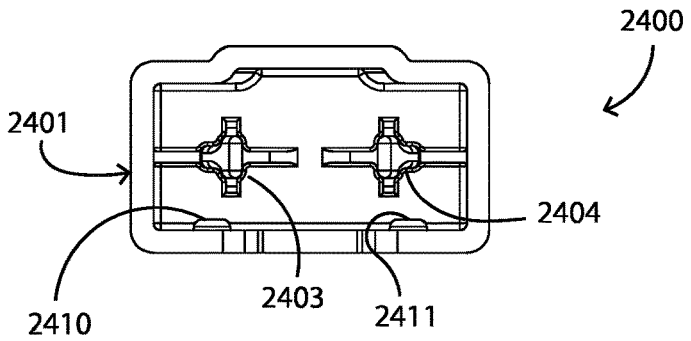

The invention will be more clearly understood from the following description of some embodiments thereof, given by way of example only with reference to the accompanying drawings in which:

FIG. 1 is a perspective view of a liner crimp device of the invention,

FIGS. 2(*a*), 2(*b*), and 2(*c*) are perspective views of a U-shaped socket part of the device, FIG. 2(*d*) is a plan view, FIG. 2(*e*) is a side sectional view in the direction of the arrows A-A, FIG. 2(*f*) is a plan sectional view in the direction of the arrows B-B, and FIG. 2(*g*) is an end sectional view in the direction of the arrows C-C, FIGS. 3(*a*), 3(*b*), and 3(*c*) are perspective views of a plug part of the device, and FIG. 3(*d*) is a plan view, FIG. 3(*e*) is a side view, and FIG. 3(*f*) is a side sectional view in the direction of the arrows A-A in FIG. 3(*d*), FIGS. 4(*a*), 4(*b*), and 4(*c*) are perspective views of a cover part of the device, FIGS. 5(*a*), 5(*b*) and 5(*c*) are a series of top perspective views showing the plug part being inserted into the U-shaped part against the neck of a liner, FIG. 6 is a perspective views showing final crimping pressure being applied to seal the neck of the liner, FIGS. 7 and 8 are side and perspective views respectively showing cutting to separate the device halves to leave a lower half continuing to seal the liner, and the top half removed with the excess liner, FIGS. 9 and 10 are perspective views showing the cover being slid into place over the exposed crimped liner end, to seal and support it, FIG. 11 is a perspective view showing subsequent removal of the cover, FIGS. 12 and 13 are perspective views showing the cover being slid into position on the opposed side to that it performs the task of prising the limbs of the U-shaped part apart so that the plug can be released, FIGS. 14 and 15 are diagrams illustrating the manner in which the socket limbs are prised open, FIG. 16 is a perspective view showing the cover fully inserted into and over the combined socket and plug, and FIG. 17 is a perspective view showing the cover and the plug being removed as a unit from the socket, thereby leaving the socket limbs open for lateral movement of the liner out of the socket as indicated by the arrows;

FIG. 18 is an underneath perspective view of another device of the invention in use, and FIGS. 19(*a*) and (*b*) are perspective views of a socket and a plug respectively of an alternative device, and FIG. 19(*c*) is a front view of a cover of this device.

Referring to FIG. 1 a liner crimping device 1 comprises a U-shaped socket 200, a plug 300, and a cover 400. The plug 300 is configured to fit within the U-shaped socket so that the closed end and limbs of the socket 200 form an enclosure together with the leading end of the plug 300 to crimp the neck of a film liner. In this specification the open end of the socket 200 is defined as being the proximal end, the closed end of the socket being the distal end, whereby the plug 300 is pushed distally into the socket for crimping.

In more detail, as shown in FIG. 2 the socket 200 has a top half 201 and a bottom half 251 which are joined together by a bridge 202 at the closed end. The top half 201 has limbs 205 and 206, and the bottom half has limbs 255 and 256. The top half has inwardly facing teeth 203 and 204 on the limbs 205 and 206 respectively, and the bottom half has opposing lines of teeth 253 and 254 on the limbs 255 and 256 respectively. The top component 201 has a pair of parallel recesses 270 and 271 extending in the proximal direction, for accommodation of tines of the cover 400 as described in more detail below.

As shown in FIG. 3 the plug 300 has top and bottom halves or components 301 and 351 corresponding to the socket halves 201 and 251 respectively. The components are joined by a bridge 302 at the distal end. The plug top half 301 has laterally outwardly facing lines of teeth 303 and 304, and the bottom half 351 has corresponding lines of teeth 353 and 354. The teeth of the plug 300 are matched for engagement with the teeth of the socket 200 when the plug is pressed into the socket, and the plug 300 is configured to be a press-fit in the socket with force from a tool being required for pushing the plug distally into the socket for complete engagement for crimping. The plug 300 has top and bottom plates 305 and 355 which provide exposed top and bottom surfaces, and which overhang the lines of teeth and, in use, overlie parts of the top and bottom surfaces of the plug 200 alongside the teeth. The plug 300 also has snap-fit lugs 308 and 358, which engage with corresponding recesses in the socket for snap-fitting engagement.

Referring to FIGS. 4(*a*), (*b*), and (*c*) the cover 400 is configured to fit around the closed end of the socket, with a web 401 overlying the closed end of the socket and the leading end of the plug-in use, and hance covering exposed edges of crimped and cut film, as described in more detail below. The cover 400 also has an end wall 402 for engaging the closed end of the socket, and a pair of prongs or tines 403 and 404 extend from the end wall 402. The prongs or tines 403 and 404 fit into the elongate recesses 270 and 271 of the socket 200 when the cover 400 is in the covering position.

The cover is dual-purpose and as described in more detail below, it can be removed from the covering position and used as a tool to open the device because the tines 403 and 404 are configured and located so that they can engage the small space on each lateral side of the plug at its proximal end.

Use of the Device 1

Use of the device 1 is shown in FIGS. 5 to 15 inclusive. As shown in FIG. 5(*a*) the socket is positioned so that its limbs surround the neck of a film or liner near its mouth to form a neck of liner L. The plug 300 is then pressed into the socket between the limbs with manual pressure as shown in FIGS. 5(*b*) and 5(*c*). The pressure required increases as the leading moves distally into the socket, as more teeth are engaged and there is less play in the distal, closed, end of the socket 200. Finally, to complete the crimping operation, a tool 500 is used to apply the final pressure to force the plug 300 the final distance into the socket 200, as shown in FIG. 6. At this stage the liner L is fully crimped, with the neck of film material pressed very tightly together to that there are no openings or gaps and the contents of the liner are fully sealed.

At some later stage, the socket and plug top and bottom halves are separated by use of a scissors-type tool which cuts through the bridges 202 and 302 and the liner itself. That leaves the bottom halves 251 and 351 crimping the liner and the liner edges are exposed. This is shown in FIG. 8. The top halves 201 and 301 with the excess liner may be discarded safely.

Then, the cover 300 is slid into position so that the wall 401 covers over the exposed liner edges, as shown in FIGS. 9 and 10. The cover may be left in situ for a prolonged period because the bag is fully sealed and there are no exposed liner or film edges.

When, subsequently, it is desired to open the crimp for access to the contents of the bag formed by the film the cover 400 is slid off the socket/plug combination, and is then pushed towards them from the opposed, proximal, side. The tines 403 and 404 are positioned, and have leading tapered ends, to engage in the small space on each side. These are indicated by the numerals 261 and 262. As shown in FIGS.

12 to 15 the cover 400 is pushed distally, thereby prising the limbs 255 and 256 of the socket apart.

As shown in FIGS. 16 and 17 the combined cover and plug are moved together proximally away from the socket, leaving a clear path for movement of the liner L proximally between the limbs, as shown particularly in FIG. 17. By removing the cover 400 and the plug lower component 351 as a unit together and moving the socket lower component 251 distally (or the liner L proximally) the action of opening the liner is particularly convenient, with little chance of any powder near the top of the liner being dislodged.

In another embodiment the cover and the plug have snap-fitting lock features for a positive engagement after the cover has been pressed distally to prise open the socket limbs. FIG. 18 shows such an arrangement, in which a device 1000 has the same features as the device 1, with a socket lower component 1251 and a plug lower component 1351 together providing tine spaces 1261 and 1262, and a cover 1400. A lower face of the plug 1351 has a pair of ridges 1001 extending laterally and being symmetrically arranged about the longitudinal axis. The cover 1400 has a pair of slots 1002 arranged for snap-fitting engagement with the ridges 1001. The features 1001 and 1002 are configured so that they engage when the cover has been inserted fully home to open the socket lower component 1251. Because the cover and the plug are locked together the cover 1400 and the plug 1351 can be more easily removed as a unit to open the socket lower component 1251, thereby allowing it to be removed without disturbing the liner and hence minimising risk of powder being dislodged. This is shown in FIG. 17. The arrows in this drawing show the liner being moved proximally, however it may be just as easily achieved by moving the socket distally without any movement of the liner.

FIGS. 19(*a*), (*b*), and (*c*) show an alternative device, comprising a socket 2200, a plug 2300, and a cover 2400. The socket 2200 has upper and lower components 2201 and 2252 which have teeth 2203 and 2253 which are shorter than those of the above devices. The top and bottom components are symmetrically arranged about a plane between them, being joined by the frangible bridge. At its distal end the socket 2200 has a series of through holes 2260 extending from top to bottom. These holes 2260 allow a tie wrap to be trained through the socket for engagement with a security tag.

The plug 2300 has corresponding shorter teeth 2303 and 2353, and its top and bottom components 2301 and 2351 are also symmetrically arranged. The top component 2301 has a flange 2305 facing the bottom component 2351, and the bottom component 2351 has a flange 2355 facing the top component 2301. The flanges 2305 and 2355 each has a slot on each side extending laterally closer to the proximal end than the distal end. As shown in FIG. 19 ©, the cover 2400 has a main body 2401 with tines 2403 and 2404 for performing the same function as the tines of the other devices. However, in this case the cover housing 2401 has a pair of ridges 2410 and 2411 for snap-fitting engagement in the slots 2304 and 2354 of the flanges of the bottom component. This shows that the snap-fitting or lock features may be arranged other than as done in the device 1000.

Some devices of the invention have two covers, one configured to act as a cover for the bottom components after separation, and one configured to act as a cover for the top components after separation. Hence, one cover can be used as described above for a bottom component and the other can be used to cover exposed liner in the top component after it is removed, just in case there are any particles which can dislodge from the part of the liner which is removed (see FIG. 8).

Because the top and bottom components of both the socket and the plug are symmetrical about a lateral plane between them and through the frangible bridges, if a second cover is provided it may be used on either component. The same comments apply to the devices 1 and 1000. For example, one cover could cover the top of the assembly in the lower part of FIG. 8 and the other could cover the underneath, hidden, side of the top assembly of FIG. 8.

It will be appreciated that the invention provides a crimping device which is simple to manufacture and to use, employing a simple action of pushing a plug into a socket between limbs for crimping. The exposed crimped edges of the film may be easily covered by pushing the cover 400 over them, and the device may be left as long as is desired in this position. When the time comes to remove the crimp there is no need to obtain a particular tool, as the cover is simply removed from its covering position and used as a tool. Having a dual-purpose cover provides simplicity in use and manufacture, and the end user does not need to keep a dedicated tool for the precise dimensions of the device to open it.

Other advantages are as follows.

- The cover part helps prevent the crimp from opening and protects the cut end of the liner from being touched or tampered with.
- Complete surrounding of raised ribs help to prevent slippage of the liner and accidental removal of the crimp from the liner.
- The device provides a pivoting point to support and maintain the closure of the crimp and also allow the arms of the crimp to be opened if required.
- The prongs on the cover part are fitted to the U-shaped part using guide holes to aid in securing the cover part to the U-shaped part, The guide holes are recessed into the U-shaped part.
- Full assembly allows for an anti-tamper device to be added if required.
- Allowing one to open the crimp device without an extra tool. The crimp device is self-opening.

Components of embodiments can be employed in other embodiments in a manner as would be understood by a person of ordinary skill in the art. The invention is not limited to the embodiments described but may be varied in construction and detail. For example, an anti-tamper device may be provided.

The invention claimed is:

1. A bag or liner film crimping device comprising:

a socket having top and bottom components linked by a bridge, each component having a pair of opposed limbs extending proximally away from a distal end, wherein said bridge is capable of being broken or cut by a user;

a plug having top and bottom components linked by a bridge wherein said bridge is capable of being broken or cut by a user, wherein said plug is configured to fit between the socket limbs with a friction fit in a movement from proximal at an open end of the socket to distal when inserted in the socket; and a cover comprising a top wall and being configured to slide over the socket bottom component in a proximal direction to a covering position at which the top wall covers a space at the distal end extending from a first socket bottom component limb of the socket bottom component limbs to a second socket bottom component limb of the socket bottom component limbs when only the socket bottom component remains after the socket and plug top and bottom components have been separated by breaking or cutting the bridges;

wherein the cover is dual-purpose and includes at least one tine for, in a second use after removal from said covering position, prising a socket bottom component limb from the plug as the cover is slid distally.

2. The device as claimed in claim 1, wherein the cover includes at least two tines for, in the second use after removal from said covering position, prising the socket bottom component limbs from the plug as the cover is slid distally.

3. The device as claimed in claim 1, wherein the cover comprises the top wall, and an end wall, and the at least one tine extends from the end wall.

4. The device as claimed in claim 1, wherein the socket bottom component includes recesses to accommodate the tine or tines when the cover is in the covering position.

5. The device as claimed in claim 1, wherein at least one limb of said socket top and bottom components has inwardly directed teeth.

6. The device as claimed in claim 1, wherein at least one limb of said socket top and bottom components has inwardly directed teeth; and wherein at least one plug component has outwardly directed teeth for engagement with the teeth of the socket.

7. The device of claim 1, wherein the cover and the plug bottom component are configured to engage each other to be removed as a unit to expose the socket bottom component limbs and allow removal of a liner through the socket bottom component in the proximal direction.

8. The device as claimed in claim 1, wherein the cover and the plug bottom component are configured to engage each other to be removed as a unit to expose the socket bottom component limbs and allow removal of a liner through the socket bottom component in the proximal direction; and wherein the plug bottom component and the cover comprise snap-fitting features configured for engaging together when the cover has been slid distally to prise the socket bottom component limbs apart.

9. The device as claimed in claim 1, wherein the cover and the plug bottom component are configured to engage each other to be removed as a unit to expose the socket bottom component limbs and allow removal of a liner through the socket bottom component in the proximal direction; and wherein the plug bottom component and the cover comprise snap-fitting features configured for engaging together when the cover has been slid distally to prise the socket limbs apart; and wherein said features comprise ridges on the plug bottom component or the cover and slots in the plug bottom component or the cover.

10. The device as claimed in claim 1, wherein the socket is symmetrical about a plane extending in a proximal-distal direction and through the socket bridge, and wherein the plug is symmetrical about a plane extending in the proximal-distal direction and through the plug bridge, whereby the socket and plug bottom and top components are interchangeable.

11. The device as claimed in claim 1, wherein the device comprises at least two covers, one configured to act as a cover for the socket bottom component and one configured to act as a cover for the socket top component, after separation of said components.

12. A method of use of a bag or liner film crimping device comprising:

a socket having top and bottom components linked by a bridge, each component having a pair of opposed limbs extending proximally away from a distal end, wherein said bridge is capable of being broken or cut by a user;

a plug having top and bottom components linked by a bridge wherein said bridge is capable of being broken or cut by a user, wherein said plug is configured to fit between the socket limbs with a friction fit in a movement from proximal at an open end of the socket to distal when inserted in the socket; and a cover comprising a top wall and being configured to slide over the socket bottom component in a proximal direction to a covering position at which the top wall covers a space at a distal end extending from a first socket bottom component limb of the socket bottom component limbs to a second socket bottom component limb of the socket bottom component limbs when only the socket bottom component remains after the socket and plug top and bottom components have been separated by breaking or cutting the bridges, the method comprising:

crimping a film within the socket by pressing the plug distally into the socket, cutting through the film and the bridges between the top and bottom socket and plug components, and sliding the cover proximally onto the bottom socket and plug components to a covering position so that the top wall covers exposed edges of the film and the space at the distal end extending from the first socket bottom component limb to the second socket bottom component limb, wherein the cover is dual-purpose and includes at least one tine and the method comprises further steps of removing the cover from the covering position and sliding the cover distally so that the tines prise open the socket limbs, and releasing the crimped film.

13. The method as claimed in claim 12, wherein the cover includes at least two tines, and the method comprises further steps of removing the cover from the covering position and sliding the cover distally so that the tines prise open the socket bottom component limbs, and releasing the crimped film; and wherein the cover and the plug are removed together, and the liner is removed by proximal movement between and away from the socket limbs.

14. The method as claimed in claim 12, wherein the cover includes at least two tines and the method comprises further steps of removing the cover from the covering position and sliding the cover distally so that the tines prise open the socket bottom component limbs, and releasing the crimped film; and wherein the cover and the plug are removed together, and the liner is removed by proximal movement between and away from the socket limbs;

and wherein the cover is slid distally until snap-fitting features of the cover and the plug engage.

* * * * *